US010336083B2

(12) United States Patent
Zhang et al.

(10) Patent No.: US 10,336,083 B2
(45) Date of Patent: Jul. 2, 2019

(54) INK CARTRIDGE CHIP, INK CARTRIDGE AND OPERATION METHOD FOR GIVING RESPONSE TO PRINTING WORK

(71) Applicant: HANGZHOU CHIPJET TECHNOLOGY CO., LTD., Zhejiang (CN)

(72) Inventors: Zhengdong Zhang, Zhejiang (CN); Yun Sun, Zhejiang (CN); Shan Luo, Zhejiang (CN)

(73) Assignee: HANGZHOU CHIPJET TECHNOLOGY CO., LTD., Zhejiang (CN)

( * ) Notice: Subject to any disclaimer, the term of this patent is extended or adjusted under 35 U.S.C. 154(b) by 2 days.

(21) Appl. No.: 15/744,397

(22) PCT Filed: May 17, 2016

(86) PCT No.: PCT/CN2016/082285

§ 371 (c)(1),
(2) Date: Jan. 12, 2018

(87) PCT Pub. No.: WO2017/173702

PCT Pub. Date: Oct. 12, 2017

(65) Prior Publication Data

US 2018/0215157 A1 Aug. 2, 2018

(30) Foreign Application Priority Data

Apr. 7, 2016 (CN) ..... 2016 1 0211985

(51) Int. Cl.
*B41J 2/175* (2006.01)

(52) U.S. Cl.
CPC ..... *B41J 2/17503* (2013.01); *B41J 2/17546* (2013.01)

(58) Field of Classification Search
CPC .. B41J 2/17503; B41J 2/1752; B41J 2/17526; B41J 2/17546
USPC ..... 347/86, 87
See application file for complete search history.

(56) References Cited

U.S. PATENT DOCUMENTS 5,610,635 A * 3/1997 Murray ..... B41J 2/1752 347/19
9,104,140 B2 * 8/2015 Ignatchenko ..... G03G 15/0894
9,630,417 B2 * 4/2017 Campbell-Brown ..... B41J 2/1753

* cited by examiner

*Primary Examiner* — An H Do
(74) *Attorney, Agent, or Firm* — Hauptman Ham, LLP

(57) ABSTRACT

The application provides an ink cartridge chip, an ink cartridge and an operation method for giving response to printing work, and belongs to the technical field of printing. The ink cartridge chip comprises a storage module at least provided with a first ink quantity data block and a second ink quantity data block which share data with a printer and make the printer have one printing mode, wherein the first ink quantity data block is fixed in the printing mode, and the second ink quantity data block is variable in the printing mode. The ink cartridge comprises the ink cartridge chip. The application with a printing system is easy, convenient and fast, universality is high, printing at a high ink utilization rate is achieved in one printing mode, and the problems of resource waste, consumable loss, high cost and the like are solved.

20 Claims, 2 Drawing Sheets

INK CARTRIDGE CHIP, INK CARTRIDGE AND OPERATION METHOD FOR GIVING RESPONSE TO PRINTING WORK

RELATED APPLICATIONS

Cross Reference to Related Applications

This application is a national application of PCT/CN2016/082285, filed on May 17, 2016 and claims benefit of and priority to Chinese Patent Application No. 2016102119851 entitled "Ink Cartridge Chip, Ink Cartridge and Operation Method for Giving Response to Printing Work" which was filed on Apr. 7, 2016, the contents of which are all hereby incorporated by reference.

FIELD OF TECHNOLOGY

The application relates to the technical field of printing systems provided with replaceable printing components, in particular to an ink cartridge chip used for a printing system, an ink cartridge and an operation method for giving response to printing work.

BACKGROUND ART

A printing system generally comprises a printer, an ink cartridge, a chip mounted on the ink cartridge, and the like. In printing work, images and characters are formed on printing media according to control information output from the printing system. In the printing process, replaceable printing components such as the ink cartridge are large in loss and need to be replaced frequently at the end of the life of the replaceable printing components. In the replacement process, an original ink cartridge or a same-generation compatible ink cartridge is generally needed for replacement so as to be compatible with the printer and give response to printing work normally. However, if the expensive original ink cartridges are used for a long time, the cost of printing consumption can be excessively high, requirements of all users cannot be met, and fair competition of other suppliers is limited. In addition, along with continuous upgrading of the printing technique, firmware of the printer generally needs to be upgraded once in two to three years, and a printer of a novel type is released, so ink cartridges which have already been purchased by users and have not been used yet have to be discarded, and the same-generation compatible ink cartridges matched with the upgraded printer have to be purchased again, consequentially, the cost of the printing consumption is increased, severe resource waste is caused, and residual ink and ink cartridges can even cause environment pollution.

In addition, it is found in long-term use that the utilization rate of ink in the ink cartridge is not high enough, and the ink is not completely consumed. Meanwhile, when a certain printing system is used for ink-jet printing through the ink cartridge for the first time, a low-ink state is displayed when about 15% of ink is still left; when an ink-out state is displayed by the printing system, ink needs to be added into the ink cartridge again for the second round of printing, or a new ink cartridge is directly used for the second round of printing; when about 30% of ink is left in the printing process, the low-ink state is displayed by the printing system again, shortly afterwards, a user is informed of ink-out information in this round of printing, and the quantity of ink left in the ink cartridge in this round of printing is larger than the quantity of ink left in the ink cartridge in the first round of printing. After a long period of time, the utilization rate of ink in the ink cartridge is not high, consumable loss is large, cost is extremely high, and the printing efficiency is low.

For this reason, for making ink consumable be compatible with printing systems of all big brands, certain compatible ink consumable manufacturers adopt the method sequentially including data encryption, intermediate transmission and decryption to make replaceable components compatible with the printing systems; certain manufactures adopts the method of conducting function simulation on relevant components such as sensors used for detecting the ink quantity, however, the method only solves the compatibility problem and cannot solve the problem of low ink utilization rate and low printing efficiency at the same time.

For solving the problem of low ink utilization rate, analog sensors used for detecting the filling degree of recording materials, such as ink, in the ink cartridge are successfully adopted by the compatible ink consumable manufacturers, ink consumption is actually controlled according to data in an ink cartridge chip, and thus the ink quantity is accurately measured. However, for printers of different types, the scheme is poor in universality. Since different printing ink consumption threshold values for stopping printing are set for printers of different types, for example, for certain printers, printing is stopped when the ink consumption rate reaches 120% or 100%, so that for achieving accurate measurement of ink consumption and avoiding extra ink waste, different quantities of ink needs to be filled into printers of different types. Obviously, the scheme has limitation, and even extra ink waste can be caused.

SUMMARY OF THE INVENTION

For solving the above technical problems, the application aims to provide an ink cartridge chip, an ink cartridge and an operation method for giving response to printing operation, which are compatible with printing systems and suitable for printers of various types and can achieve the high ink utilization rate of the ink cartridge.

The application provides an ink cartridge chip. The ink cartridge chip comprises a storage module, wherein the storage module is at least provided with a first ink quantity data block and a second ink quantity data block, the first ink quantity data block and the second ink quantity data block share data with a printer and make the printer have one printing mode, the first ink quantity data block is a fixed ink quantity data block in the printing mode, and the second ink quantity data block is a variable ink quantity data block in the printing mode.

The ink cartridge chip is authenticated with a printer through the first ink quantity data block and the second ink quantity data block, normal communication between the ink cartridge chip and the printer is established after authentication succeeds, the printer is allowed to operate, and printing work is conducted in one printing mode after printing work starts. The printing mode refers to that printing is conducted by keeping the ink quantity in a specific state and not restrained by the printing speed, the printing color and the like. In this way, the ink cartridge can be mounted on the ink cartridge so as to be recycled, ink in ink cartridges of different types can be completely and efficiently used without switching the printing mode, so resource waste is avoided, and efficient printing is achieved.

Preferably, the first ink quantity data block comprises a first ink quantity parameter used for triggering the second ink quantity data block to change, and an ink quantity threshold value.

Preferably, the first ink quantity parameter is smaller than the ink quantity threshold value.

Preferably, the first ink quantity data block is determined according to the final ink consumption value when an ink cartridge is applied to a printer system for the first time.

Preferably, the second ink quantity data block comprises a second ink quantity parameter, and the second ink quantity parameter is set to be in the initial state in the ink cartridge chip and then controlled along with a printer.

Preferably, the initial state is set to be the state that residual ink still exists in the ink cartridge when the printer runs out of ink.

Preferably, the second ink quantity parameter increases positively from the moment that the second ink quantity parameter is controlled by the printer.

Preferably, when the ink cartridge provided with the ink cartridge chip is applied to the printing system, the printing mode displayed by the printer is that the ink quantity value of the ink cartridge is kept within a fixed range.

Preferably, the ink cartridge chip of the invention further comprises a logic operation module used for calculating the first ink quantity data block and the second ink quantity data block.

The application further provides an ink cartridge which comprises the ink cartridge chip.

The ink cartridge can be suitable for and compatible with printing systems of various different types, ink is used efficiently, resource waste is avoided, and cost is further reduced for enterprises.

The ink cartridge chip comprises a storage module, wherein the storage module is at least provided with a first ink quantity data block and a second ink quantity data block, the first ink quantity data block and the second ink quantity data block share data with a printer and make the printer have one printing mode, the first ink quantity data block is a fixed ink quantity data block in the printing mode, and the second ink quantity data block is a variable ink quantity data block in the printing mode.

Preferably, the first ink quantity data block comprises a first ink quantity parameter used for triggering the second ink quantity data block to change, and an ink quantity threshold value.

Preferably, the first ink quantity parameter is smaller than the ink quantity threshold value.

Preferably, the first ink quantity data block is determined according to the final ink consumption value when an ink cartridge is applied to a printer system for the first time.

Preferably, the second ink quantity data block comprises a second ink quantity parameter, and the second ink quantity parameter is set to be in the initial state in the ink cartridge chip and then controlled along with a printer.

Preferably, the initial state is set to be the state that residual ink still exists in the ink cartridge when the printer runs out of ink.

Preferably, the second ink quantity parameter increases positively from the moment that the second ink quantity parameter is controlled by the printer.

Preferably, when the ink cartridge provided with the ink cartridge chip is applied to the printing system, the printing mode that the ink quantity value of the ink cartridge is kept within a fixed range is displayed by the printer.

Preferably, the ink cartridge of the application further comprises a logic operation module used for calculating the first ink quantity data block and the second ink quantity data block.

The application further provides an operation method for giving response to printing work, and the operation method is used for a printing system and comprises the steps of:

receiving a reading instruction for a printer to conduct printing work through an ink cartridge chip;

sending a preset first ink quantity data block and a preset second ink quantity data block to the printer through the ink cartridge chip, setting the printer to be in one printing mode if the printer responds successfully, and feeding printer consumption data back to the ink cartridge chip; otherwise, giving no response to printing work;

after printing work starts, keeping the preset value of the first ink quantity data block unchanged, and changing the second ink quantity data block along with the change of the printer consumption data.

According to the operation method for giving response to printing work, the two ink quantity data blocks are preset in the ink cartridge chip, the preset value is a memory numerical value of an original ink cartridge chip matched with the printer, matching authentication with the printer can be achieved through the two ink quantity data blocks, and compared with the method sequentially including encryption, intermediate transmission and decryption, the authentication process is simpler and can be completed more conveniently and rapidly. Once authentication succeeds, response is normally given to printing work, the two ink quantity data blocks are preset to fixed values, and the printing mode is also set in one state accordingly; after printing work starts, for maintaining the printing mode, the first ink quantity data block is kept unchanged, and the second ink quantity data block can be affected by consumption data of the printer and serves as internal consumption data of the ink cartridge chip. The method is suitable for printing systems of various types, ink is fully used in one printing mode, efficient work is achieved, and resource waste is avoided.

Preferably, the first ink quantity data block comprises a first ink quantity parameter used for triggering the second ink quantity data block to change, and an ink quantity threshold value.

Preferably, the first ink quantity parameter is smaller than the ink quantity threshold value.

Preferably, the first ink quantity data block is determined according to the final ink consumption value when an ink cartridge is applied to the printer system for the first time.

Preferably, the preset value of the second ink quantity data block can be set to realize the state that residual ink still exists in the ink cartridge when the printer runs out of ink.

Preferably, the second ink quantity data block increases positively from the moment that the second ink quantity data block is controlled by the printer.

The application has the following beneficial effects that: The ink cartridge chip, the ink cartridge and the operation method for giving response to printing work of the invention can be authenticated with printing systems easily, conveniently and rapidly, the universality is high, printing at a high ink utilization rate is achieved in one printing mode, and the problems of resource waste, consumable loss, high cost and the like are solved.

DETAILED DESCRIPTION OF THE INVENTION

Figure 1:
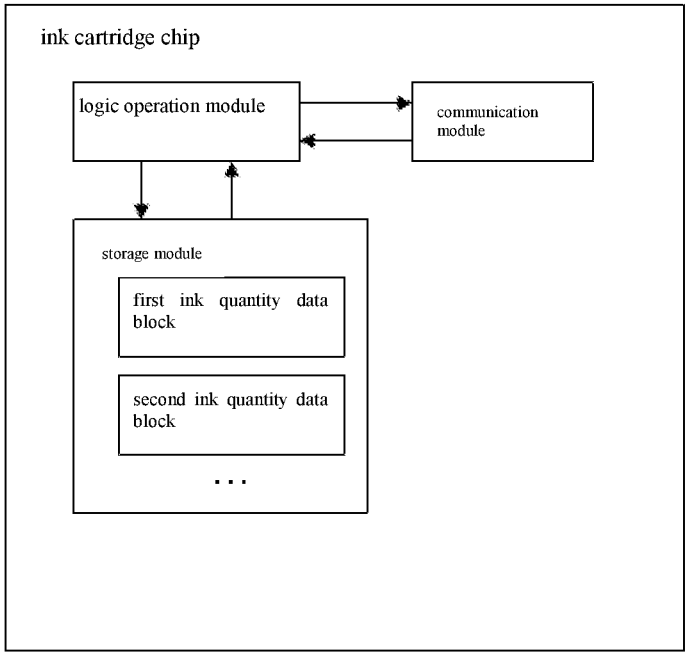
FIG. 1 is an internal structure diagram of an ink cartridge chip of the invention.
Figure 2:
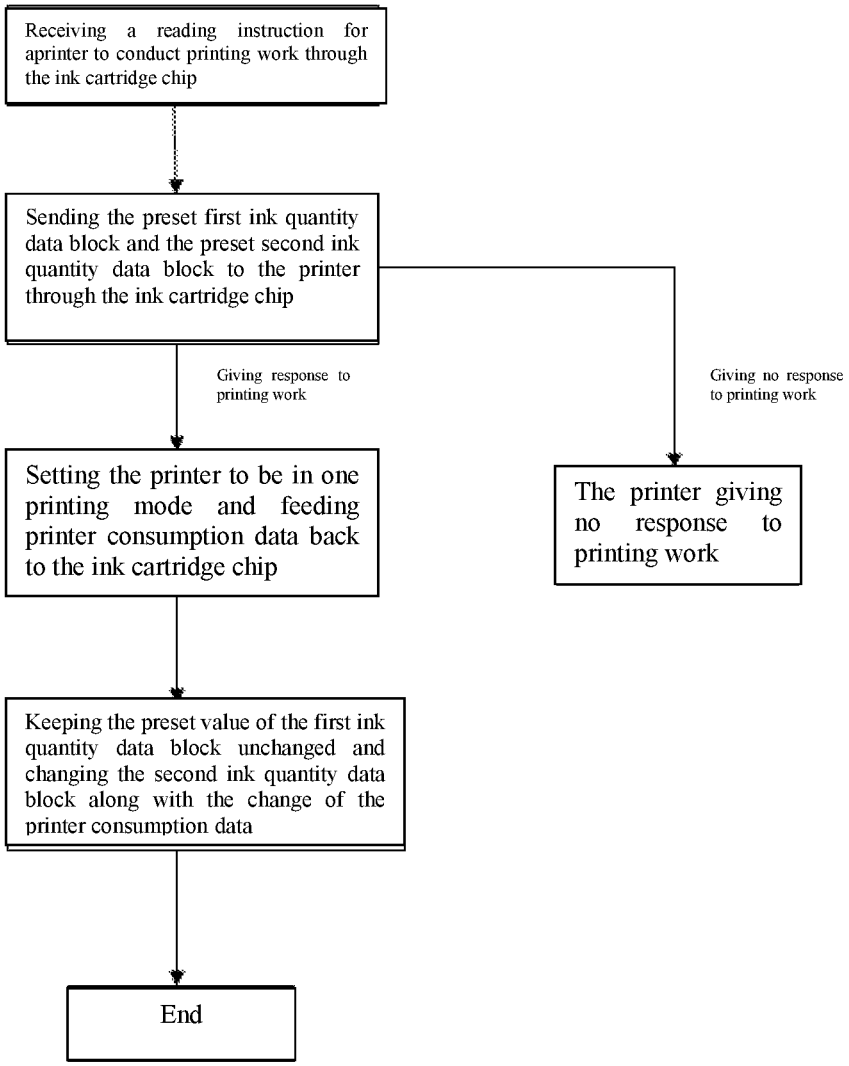
FIG. 2 is a flow diagram of an operation method for giving response to printing work of the invention.

A further detailed description of the invention is given as follows with accompanying drawings.

During actual applications, a scheme for ink cartridges which can be compatible with printing systems of various types and matched with printers easily, conveniently and rapidly for printing work and can achieve efficient utilization ink is not available yet, and thus a deep study on the whole printing process of a whole printing system is made by us.

Generally, the whole ink consumption process of a new ink cartridge full of ink includes three stages, and three printing states can be achieved in the process according to the change of the ink quantity or the ink level; the first state refers to a normal ink consumption state displayed by a printer and can be approximately defined as the stage with the residual ink quantity being 100%-20%; the second state refers to a low-ink state displayed by the printer and can be approximately defined as the stage with the residual ink quantity being about 20%; the third state refers to an ink-out state displayed by the printer and can be approximately defined as the stage with the residual ink quantity being almost 0%. In the three stages of printing, two types of area data relevant to the ink quantity are stored in the ink cartridge chip and change differently in the three printing states. The two types of area data are defined as the ink quantity data A and the ink quantity data B here, wherein the ink quantity data A further include an ink quantity parameter A1 and an ink quantity parameter A2, the ink quantity data A are stored in an address area A, and the ink data B are stored in an address area B. In the first state, the ink quantity parameter A1 and the ink quantity parameter A2 increase along with ink consumption, and the ink quantity data B increase along with ink consumption; in the second state, the ink quantity parameter A1 continues to increase along with ink consumption, the ink quantity parameter A2 keeps unchanged after reaching a fixed threshold value M, and the ink quantity data B still increase along with ink consumption; in the third state, the ink quantity parameter A1 keeps unchanged after reaching an ink-out value, the fixed threshold value M of the ink quantity parameter A2 keeps unchanged, the ink quantity data B continue to increase along with ink consumption, and the printer is triggered to display the ink-out state when a threshold value N is reached. Wherein, even if the ink-out state is displayed by the printer, a printing system can still execute printing work.

Thus, the ink quantity data A can be used as ink quantity recording data of the ink cartridge chip, and along with continuous consumption of the ink, the data can finally reach the final recording numerical value when the ink is used up. The ink quantity data B can be used for verifying or recording ink consumption and can interact with the printer, and an error can be reported by the printer if the data in the address area B are not recorded or changed freely.

For this reason, for recycling the ink cartridge, making the ink cartridge be matched with printers of different types and fully utilizing ink, the following design is made based on the above study. As is shown in FIG. 1, an ink cartridge chip of the application comprises a logic operation module, a storage module, a communication module and other modules which are the same as those of a conventional ink cartridge chip. Wherein, the storage module is provided with a first ink quantity data block and a second ink quantity data block, and the two data blocks are new definitions of the ink quantity data A and the ink quantity data B; although the address size and area of the first ink quantity data block of the application are the same as those of the ink quantity data A and the address size and area of the second ink quantity data block of the application are the same as those of the ink quantity data B, data stored in the first ink quantity data block are different from the stored ink quantity data A, and data stored in the second ink quantity data block are different from the stored ink quantity data B.

Due to the facts that on the one hand, data in the address area B can affect normal responding to printing work of the printer, and on the other hand, if the printing modes in the three states are kept, the problems of different ink utilization rates of printers of different types and even extra resource waste can still be caused. So the first ink quantity data block and the second ink quantity data block are preset for restraining the printing system in one printing mode. The printing mode refers to that printing is conducted in the specific state of keeping the ink quantity within a fixed range and is not restrained by the printing speed, the printing color and the like. An example in the third state, namely the ink-out state, is preferred for describing the application as follows. The ink-out state refers to the state that the residual ink quantity is about 0-3% of that in the full-ink state and certain ink is left in the ink cartridge all the time instead of the state that the residual ink quantity is absolutely zero.

The first ink quantity data block comprises a first ink quantity parameter and an ink quantity threshold value. The second ink quantity data block comprises a second ink quantity parameter. At the beginning of printing, the first ink quantity parameter is preset to an ink-out value, and the ink quantity threshold value is the threshold value M mentioned above. The first ink quantity data block is determined according to the final ink consumption value when the ink cartridge is applied to the printing system for the first time, the first ink quantity data is namely the value recorded by the ink quantity data A of an existing ink cartridge at the end of the third state and it can be obtained through calculation of the logic operation module of the ink cartridge or obtained by directly reading data recorded by the ink cartridge chip for the first time. The second ink quantity data block can be obtained in this way too. Wherein, the first ink quantity parameter is smaller than the ink quantity threshold value. The first ink quantity parameter and the ink quantity threshold value are used as identifications of different ink quantity precision changes. In addition, the second ink quantity data block is also preset, the threshold value of the second ink quantity data block is set to N in the ink-out state, the second ink quantity data block is triggered by the first ink quantity parameter, and once the printing system gives response to printing work, the preset value of the first ink quantity data block is kept unchanged in the ink-out state; when the second ink quantity data block is triggered to be in the ink-out state, the second ink quantity data block is controlled by the printer in the printing mode and becomes a variable ink quantity data block. The ink quantity recording way of the printer can be a printing page recording way, and along with continuous increment of the printing pages of the printer, the second ink quantity data block increases continuously from the threshold value N.

The ink cartridge chip designed above is mounted on the ink cartridge and then applied to the printing system. The ink cartridge can be a recycled old ink cartridge or an older-version ink cartridge, so that excessive resource waste is reduced, and the ecological environment is protected.

Operation for giving response to printing work is conducted under the printing system. Firstly, the ink cartridge chip receives a reading instruction for a printer to conduct printing work; secondly, the ink cartridge chip sends the preset first ink quantity data block and the preset second ink quantity data block to the printer, then matching authentication between the printer and the ink cartridge is conducted. Since the address sizes and areas of the first ink quantity data block and the second ink quantity data block of the newly-designed ink cartridge chip are the same as those of an original chip and the preset states of the first ink quantity data block and the second ink quantity data block are set according to data in the ink-out state during primary printing work, namely the address and the data are highly matched with the printer, the printing system can easily give response to printing work rapidly and effectively, once successful responding is achieved, the printer is set to be in one printing mode, and printer consumption data are fed back to the ink cartridge chip; otherwise, no response is given to printing work. After printing work starts, the preset value of the first ink quantity data block is kept unchanged, and the second ink quantity data block changes along with the printer consumption data.

The foregoing embodiments are only used for describing preferred execution modes of the application and not used for limiting the concept and scope of the application. Various changes and improvements made by those skilled in the field according to the technical scheme of the application without deviating from the design concept of the application are all within the protection scope of the application, and technical contents requested to be protected by the application are all recorded in the Claims.

What is claimed is:

1. An ink cartridge chip, comprising a storage module; wherein the storage module is at least provided with a first ink quantity data block and a second ink quantity data block, the first ink quantity data block and the second ink quantity data block share data with a printer and make the printer have one printing mode, the first ink quantity data block is a fixed ink quantity data block in the printing mode, and the second ink quantity data block is a variable ink quantity data block in the printing mode.

2. The ink cartridge chip according to claim 1, wherein the first ink quantity data block comprises a first ink quantity parameter used for triggering the second ink quantity data block to change, and an ink quantity threshold value.

3. The ink cartridge chip according to claim 2, wherein the first ink quantity parameter is smaller than the ink quantity threshold value.

4. The ink cartridge chip according to claim 1, wherein the first ink quantity data block is determined according to the final ink consumption value when an ink cartridge is applied to a printer system for the first time.

5. The ink cartridge chip according to claim 1, wherein the second ink quantity data block comprises a second ink quantity parameter, and the second ink quantity parameter is set to be in the initial state in the ink cartridge chip and then controlled along with the printer.

6. The ink cartridge chip according to claim 5, wherein the initial state is set to be the state that residual ink still exists in the ink cartridge when the printer runs out of ink.

7. The ink cartridge chip according to claim 5, wherein the second ink quantity parameter increases positively from the moment that the second ink quantity parameter is controlled by the printer.

8. The ink cartridge chip according to claim 1, wherein when the ink cartridge provided with the ink cartridge chip is applied to a printing system, the printing mode displayed by the printer is that the ink quantity value of the ink cartridge is kept within a fixed range.

9. The ink cartridge chip according to claim 1, wherein further comprising a logic operation module used for calculating the first ink quantity data block and the second ink quantity data block.

10. An ink cartridge, wherein comprising the ink cartridge chip according to claim 1.

11. The ink cartridge according to claim 10, wherein the first ink quantity data block comprises a first ink quantity parameter used for triggering the second ink quantity data block to change, and an ink quantity threshold value.

12. The ink cartridge according to claim 10, wherein the first ink quantity data block is determined according to the final ink consumption value when an ink cartridge is applied to a printer system for the first time.

13. The ink cartridge according to claim 10, wherein the second ink quantity data block comprises a second ink quantity parameter, and the second ink quantity parameter is set to be in the initial state in the ink cartridge chip and then controlled along with the printer.

14. The ink cartridge according to claim 10, wherein when the ink cartridge provided with the ink cartridge chip is applied to a printing system, the printing mode displayed by the printer is that the ink quantity value of the ink cartridge is kept within a fixed range.

15. An operation method for giving response to printing work, wherein comprising the steps of:

receiving a reading instruction for a printer to conduct printing work through an ink cartridge chip;

sending a preset first ink quantity data block and a preset second ink quantity data block to the printer through the ink cartridge chip, setting the printer to be in one printing mode if the printer responds successfully, and feeding printer consumption data back to the ink cartridge chip, otherwise, giving no response to printing work;

after printing work starts, keeping the preset value of the first ink quantity data block unchanged, and changing the second ink quantity data block along with the change of the printer consumption data.

16. The operation method for giving response to printing work according to claim 15, wherein the first ink quantity data block comprises a first ink quantity parameter used for triggering the second ink quantity data block to change, and an ink quantity threshold value.

17. The operation method for giving response to printing work according to claim 16, wherein the first ink quantity parameter is smaller than the ink quantity threshold value.

18. The operation method for giving response to printing work according to claim 15, wherein the first ink quantity data block is determined according to the final ink consumption value when the ink cartridge is applied to the printer system for the first time.

19. The operation method for giving response to printing work according to claim 15, wherein the preset value of the second ink quantity data block can be set to realize the state that residual ink still exists in the ink cartridge when the printer runs out of ink.

20. The operation method for giving response to printing work according to claim 15, wherein the second ink quantity data block increases positively from the moment that the second ink quantity data block is controlled by the printer.

* * * * *